US010244869B2

(12) United States Patent
Head, Jr. et al.

(10) Patent No.: US 10,244,869 B2
(45) Date of Patent: Apr. 2, 2019

(54) STADIUM CHAIR

(71) Applicant: Stadium Holding, Inc., Shirley, MA (US)

(72) Inventors: H. Wayne Head, Jr., O'Donnell, TX (US); Carl W. Wilhite, Olathe, KS (US)

(73) Assignee: Stadium Holding, Inc., Shirley, MA (US)

( * ) Notice: Subject to any disclaimer, the term of this patent is extended or adjusted under 35 U.S.C. 154(b) by 67 days.

(21) Appl. No.: 15/325,388

(22) PCT Filed: Aug. 21, 2015

(86) PCT No.: PCT/US2015/046368

§ 371 (c)(1),
(2) Date: Jan. 10, 2017

(87) PCT Pub. No.: WO2016/048511

PCT Pub. Date: Mar. 31, 2016

(65) Prior Publication Data

US 2017/0164743 A1 Jun. 15, 2017

Related U.S. Application Data

(60) Provisional application No. 62/054,156, filed on Sep. 23, 2014.

(51) Int. Cl.
*A47C 1/16* (2006.01)
*A47C 4/28* (2006.01)
(Continued)

(52) U.S. Cl.
CPC ..... *A47C 1/16* (2013.01); *A47C 4/00* (2013.01); *A47C 4/28* (2013.01); *A47C 7/407* (2013.01);
(Continued)

(58) Field of Classification Search
CPC .. A47C 1/16; A47C 4/00; A47C 7/407; A47C 7/44; A47C 7/543; A47C 7/546
See application file for complete search history.

(56) References Cited

U.S. PATENT DOCUMENTS 878,889 A 2/1908 Miller
2,841,207 A * 7/1958 Sweeney ..... B63B 29/06 297/252

(Continued)

OTHER PUBLICATIONS

International Search Report dated Jan. 11, 2016 for PCT Application No. PCT/US2015/046368.

(Continued)

*Primary Examiner* — Philip F Gabler
(74) *Attorney, Agent, or Firm* — Bradley Arant Boult Cummings LLP

(57) ABSTRACT

A stadium chair has a seat frame and a backrest frame pivotally coupled to the seat frame for rotation about an axis parallel to a rear portion of the seat frame. The backrest frame is capable of forward rotation about the axis toward the seat frame and rearward rotation about the axis away from the seat frame. A biasing element coupled to either the seat frame or the backrest frame causes forward biasing of the backrest frame toward a neutral position relative to the seat frame. The biasing element allows for limited rearward rotation of the backrest frame from the neutral position and allows for forward rotation of the backrest frame from the neutral position. The chair preferably is configured to receive optional rotatable armrests that may be installed or removed without the use of tools.

21 Claims, 9 Drawing Sheets

(51) Int. Cl.
*A47C 7/54* (2006.01)
*A47C 4/00* (2006.01)
*A47C 7/40* (2006.01)

(52) U.S. Cl.
CPC ..... *A47C 7/54* (2013.01); *A47C 7/543* (2013.01); *A47C 7/546* (2013.01)

(56) References Cited

U.S. PATENT DOCUMENTS

| | | | | |
|---|---|---|---|---|
| 5,069,503 | A * | 12/1991 | Martinez | A47C 1/146 297/256 |
| 6,238,000 | B1 * | 5/2001 | Hallmark | A47C 1/03238 297/300.5 |
| 6,494,539 | B2 * | 12/2002 | Frank | A47C 4/04 297/378.1 |
| 7,543,877 | B2 * | 6/2009 | Hanson | B60N 2/24 296/65.16 |
| 2003/0047976 | A1 | 3/2003 | Hannon | |
| 2005/0082891 | A1 | 4/2005 | Lor | |
| 2009/0212614 | A1 | 8/2009 | Isaac | |

OTHER PUBLICATIONS

Written Opinion of the International Searching Authority dated Jan. 11, 2016 for PCT Application No. PCT/US2015/046368.
International Preliminary Report on Patentability dated Mar. 4, 2016 for PCT Application No. PCT/US2015/046368.

* cited by examiner

STADIUM CHAIR

TECHNICAL FIELD

The present application relates in general to chairs and in particular to a stadium chair having a forward-biased backrest.

DESCRIPTION OF THE PRIOR ART

Bleachers, such as those used to provide seating for spectators at stadiums, typically comprise only a hard, flat surface to support the buttocks of the spectator. The bleachers may be formed in several configurations, but a common configuration is a rigid metal seating beam spaced from a support surface by posts or brackets. This arrangement allows for the seating surface to be located at a desired height and provides for space under the seating beam. Some bleachers have a backrest, which is typically another rigid beam mounted to the seating beam and positioned for supporting the lower backs of spectators.

Because of their rigid construction and typical lack of cushioning, bleachers are often uncomfortable for spectators to use, especially for an extended length of time. To lessen the discomfort, seat pads of various materials and types of construction have been used. In addition, stadium chairs that are designed to be placed on the bleacher and provide both a seating surface and a backrest have been used. An example of a folding stadium chair is shown in U.S. Des. Pat. D468,548 to H. Wayne Head, Jr.

Although great strides have been made in the area of stadium chairs, many shortcomings remain.

BRIEF DESCRIPTION OF THE DRAWINGS

The novel features believed characteristic of the application are set forth in the appended claims. However, the application itself, as well as a preferred mode of use, and further objectives and advantages thereof, will best be understood with reference to the following detailed description when read in conjunction with the accompanying drawings, wherein:

Figure 1:
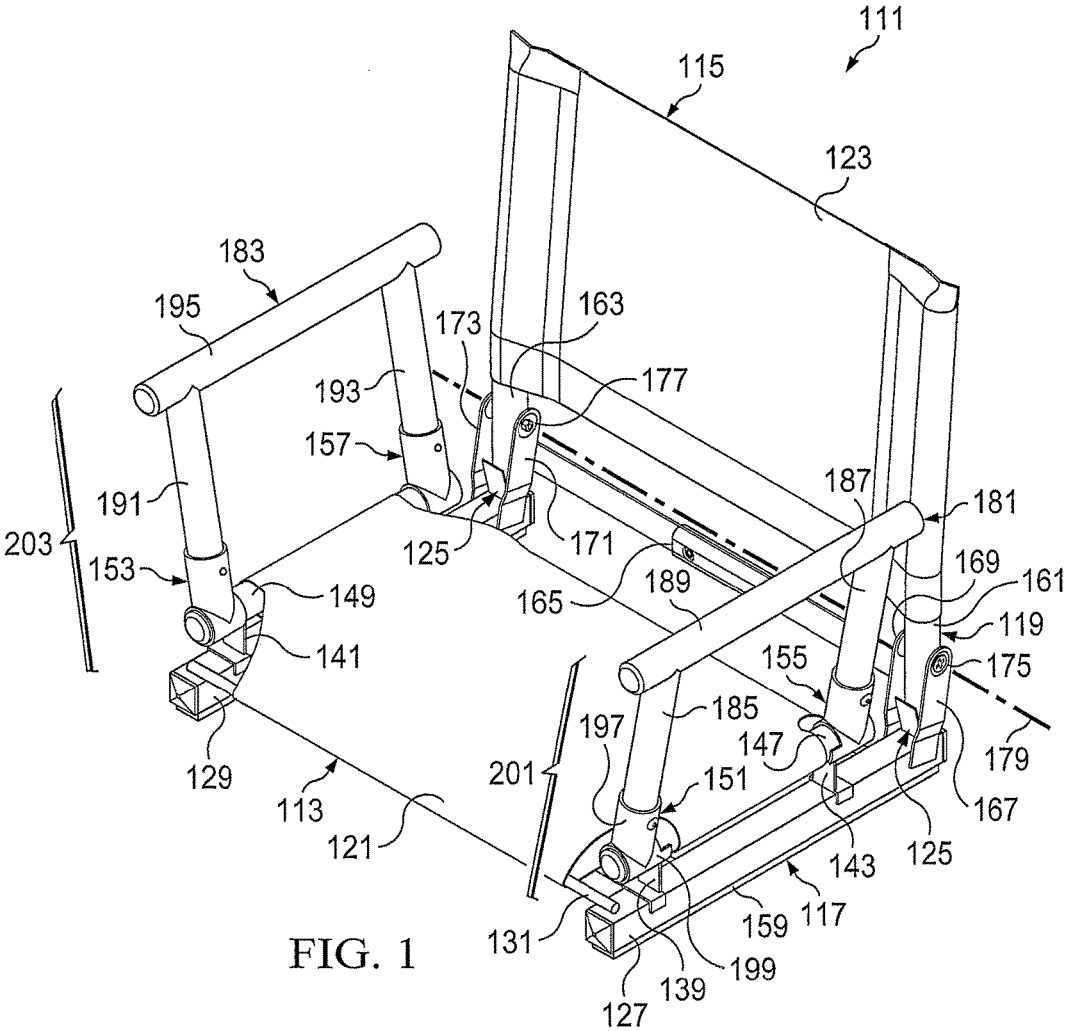
FIG. 1 is an oblique view of a stadium chair according to the present application.
Figure 2:
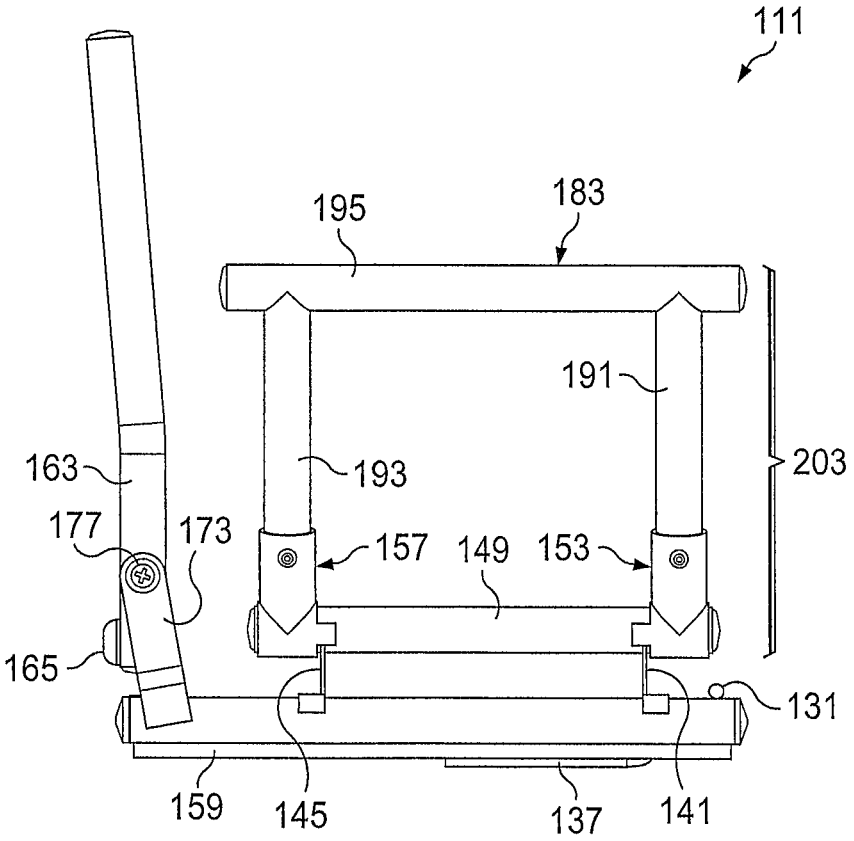
FIG. 2 is a side view of the chair of FIG. 1.
Figure 3:
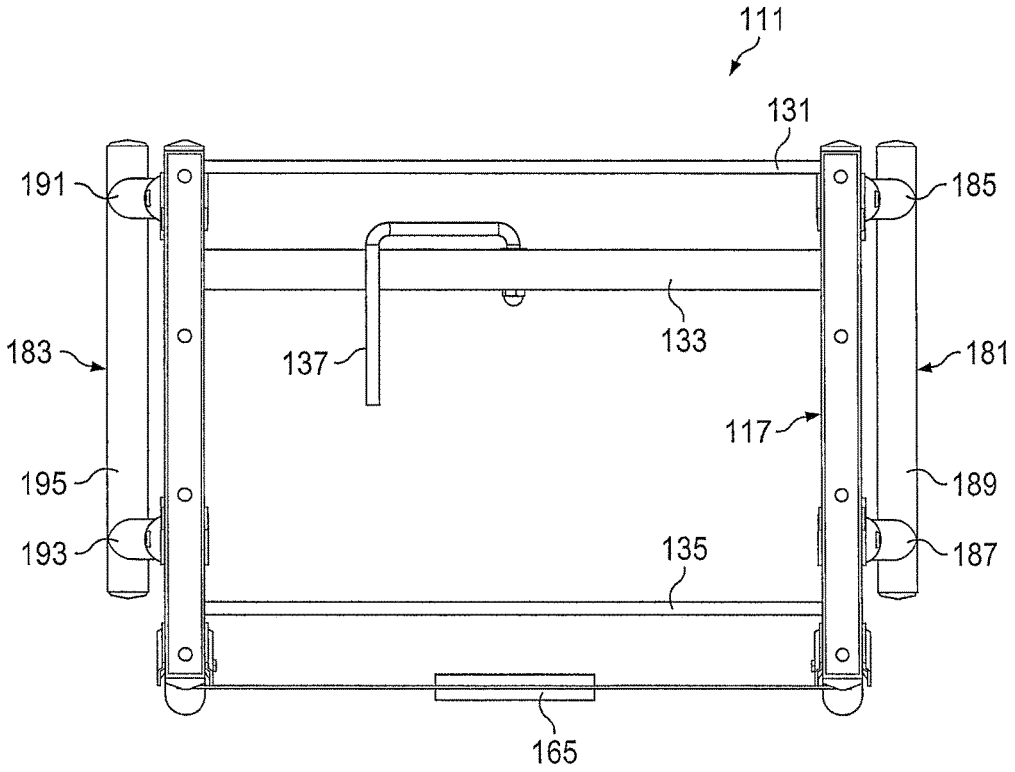
FIG. 3 is a bottom view of the chair of FIG. 1.

While susceptible to various modifications and alternative forms, specific embodiments have been shown by way of example in the drawings and are described in detail. It should be understood that the description of specific embodiments is not intended to limit the application to the particular embodiments disclosed, but the intention is to cover all modifications, equivalents, and alternatives falling within the spirit and scope of the present application as defined by the appended claims.

DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

There is a need for an improved stadium chair having a biasing element allowing for limited rearward rotation of a backrest portion of a stadium chair relative to a seat portion. This rearward rotation provides for a limited reclining or rocking motion of the backrest relative to the seat and provides increased comfort for users. In addition, there is a need for an improved stadium chair having folding arms that are able to be installed or removed without the use of tools.

Referring to FIGS. 1 through 4 in the drawings, the preferred embodiment of a stadium chair 111 according to the present application is illustrated. Stadium chair 111 includes a seat portion 113 and a backrest portion 115, with backrest portion 115 pivotally attached to seat portion 113. Seat portion 113 includes a seat frame 117 and a seat webbing 121. Backrest portion 115 includes a backrest frame 119 and a backrest webbing 123. Both seat webbing 121 and backrest webbing 123 may be flexible, rigid, and/or adjustable by a turnbuckle or other device. Webbing 121, 123 may optionally include: cushioning, including memory foam; insulating layers; and/or a pneumatic bladder.

Stadium chair 111 includes a biasing element 125 that allows backrest portion 115 to rotate rearward a limited amount relative to seat portion 113. The biasing force provided by biasing element 125 biases backrest portion 115 toward a neutral position, as shown in FIG. 1. This allows for a reclining or rocking motion of backrest portion 115 relative to seat portion 113 during use while allowing for backrest portion 115 to be rotated to a forward folded position for storage of chair 111. The frame structure of chair 111 will be described in detail first, and then embodiments of biasing element 125 are described in detail afterward.

Seat frame 117 is preferably symmetrical about a longitudinal central plane and preferably includes: first fore-to-aft frame member 127 and second fore-to-aft frame member 129; forward seat portion cross member 131, middle seat portion cross member 133, and rear seat portion cross member 135; anchor device 137; first forward armrest vertical mount tab 139 and second forward armrest vertical mount tab 141; first rear armrest vertical mount tab 143 and second rear armrest vertical mount tab 145; first armrest base 147 and second armrest base 149; first forward armrest mount 151 and second forward armrest mount 153; and first rear armrest mount 155 and second rear armrest mount 157. Each fore-to-aft frame member 127, 129 preferably has a soft material, such as foam cushion 159, located on the lower surface of members 127, 129.

Backrest frame 119 is also preferably symmetrical about a longitudinal central plane and includes: first backrest portion vertical frame member 161, second backrest portion vertical frame member 163, and handle 165. Backrest frame 119 is preferably pivotally attached to seat frame 117 by pivotally coupling first and second backrest portion vertical frame members 161 and 163, respectively, to seat portion vertical mounting tabs 167 and 169, and 171 and 173, respectively, via mechanical couplers 175 and 177, respectively. Couplers 175, 177 and their respective mounting tabs 167, 169, 171, 173 cooperate to form a pivot axis 179 about which backrest portion 115 rotates relative to seat portion 113.

In the preferred embodiment, seat frame 117 is formed and/or fashioned from a square metal tube material and backrest frame 119 is formed from a round metal tube material. However it will be appreciated that seat frame 117 and backrest frame 119 may be formed, molded and/or fashioned from other shapes, sizes, or types of materials, including, for example, round tubing, solid metal rod materials, composite materials, and/or synthetic materials, or combinations thereof, so long as the material is sufficient to support the loads placed upon it.

The preferred embodiment of chair 11 optionally includes a first armrest frame 181 and a second armrest frame 183. First armrest frame 181 preferably includes a first vertical frame member 185, a second vertical frame member 187, and a horizontal member 189. Second armrest frame 183 preferably includes a first vertical frame member 191, a second vertical frame member 193, and a horizontal member 195. Although not pictured, armrest frames 181, 183 preferably each include fixed, integrated, or removable pads. The pads could be wrapped, formed, molded or otherwise fabricated around, or fixedly or removably attached to, horizontal member 189, first vertical frame member 185, and/or second vertical frame member 187 or combinations thereof, and also horizontal member 195, first vertical frame member 191, and/or second vertical frame member 193, or combinations thereof. Pads could be one piece, or multiple pieces formed, molded, cut or otherwise fabricated from synthetic or natural material. Pads could be covered or uncovered. Covers preferably include natural or synthetic material or combinations thereof resistant to degradation.

First forward armrest mount 151 and first rear armrest mount 155 and second forward armrest mount 153 and second rear armrest mount 157, respectively, are preferably pivotally carried by forward and rear ends of first armrest base 147 and second armrest base 149, respectively, such that first forward armrest mount 151 and first rear armrest mount 155 can rotate about first armrest base 147 and second forward armrest mount 153 and second rear armrest mount 157 can rotate about second armrest base 149. Armrest mounts 151, 153, 155, 157 are similar or identical in construction and each comprise a vertical member 197 and a horizontal member 199. One end of each vertical member 197 is fixedly attached to a horizontal member 199, and it should be appreciated that members 197, 199 may be connected by welding, riveting, gluing, bolting, screwing, otherwise connecting and/or fastening, or combinations thereof.

Preferably, armrest mounts 151, 153, 155, 157 are formed, molded or otherwise fabricated from metal tubing material. It will be understood that vertical members 197 and horizontal members 199 of armrest mounts 151, 153, 155, 157 may be formed, molded, and/or fashioned from other shapes, sizes, or types of materials, including, for example, solid metal rod materials, composite materials, and/or synthetic materials, or combinations thereof.

Preferably, first armrest frame 181 and second armrest frame 183 are U-shaped members that are preferably each formed, molded and/or fashioned from a single continuous material. However, it will be appreciated that first armrest frame 181 and second armrest frame 183 may be a formed, molded, and/or fashioned from single or multiple shapes, sizes, or types of materials, including, for example, solid metal rod materials, composite materials, and/or synthetic materials, or combinations thereof.

Figure 4:
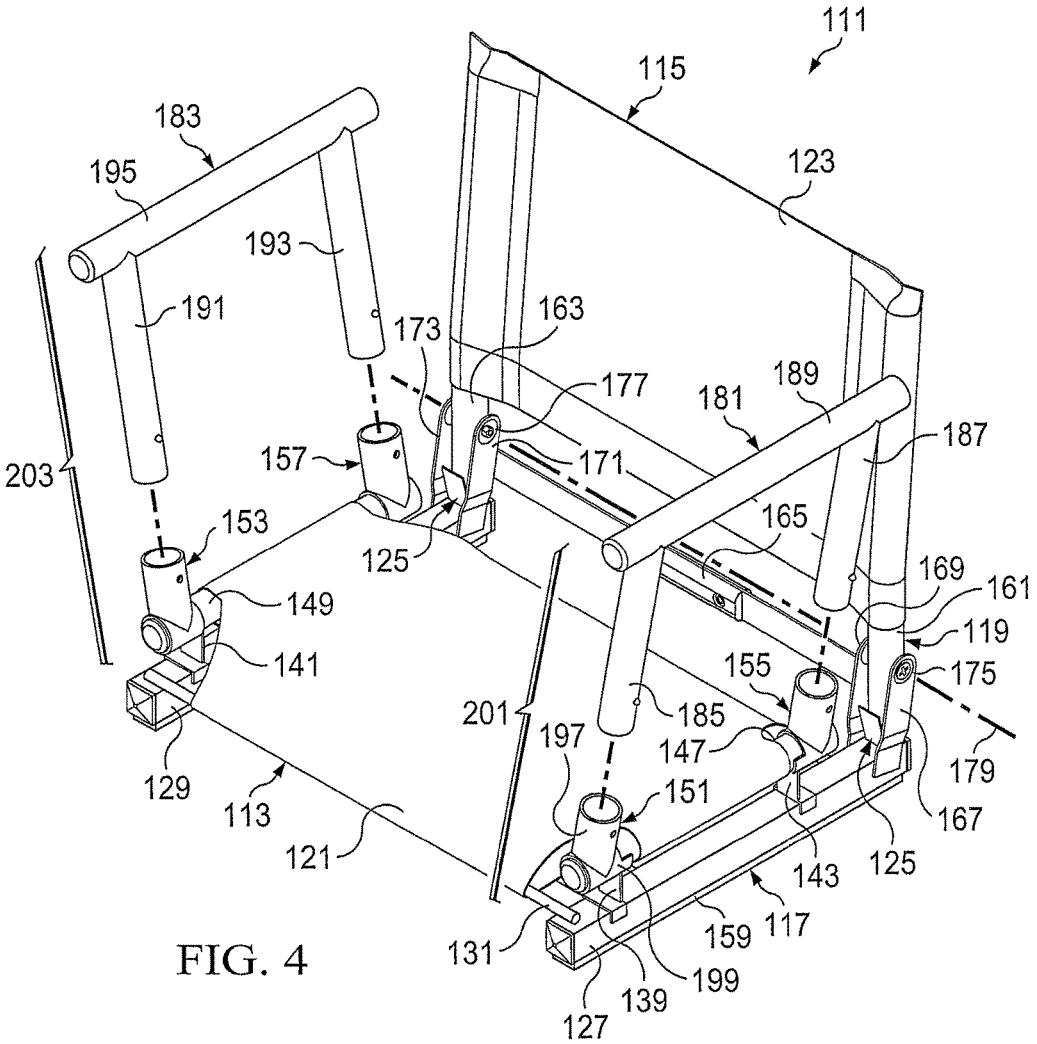
FIG. 4 is a partially exploded oblique view of the chair of FIG. 1.

In the preferred embodiment, armrest frames 181, 183 are removably connected to the hollow ends of vertical members 197 of armrest mounts 151, 153, 155, 157 to form first armrest structure 201 and second armrest structure 203. This allows for armrest frames 181, 183 to be removed from armrest mounts 151, 153, 155, 157, as shown in FIG. 4. The ability to add or remove armrest structures 201, 203 from chair 111 is discussed in detail below in relation to FIG. 10.

Figure 5:
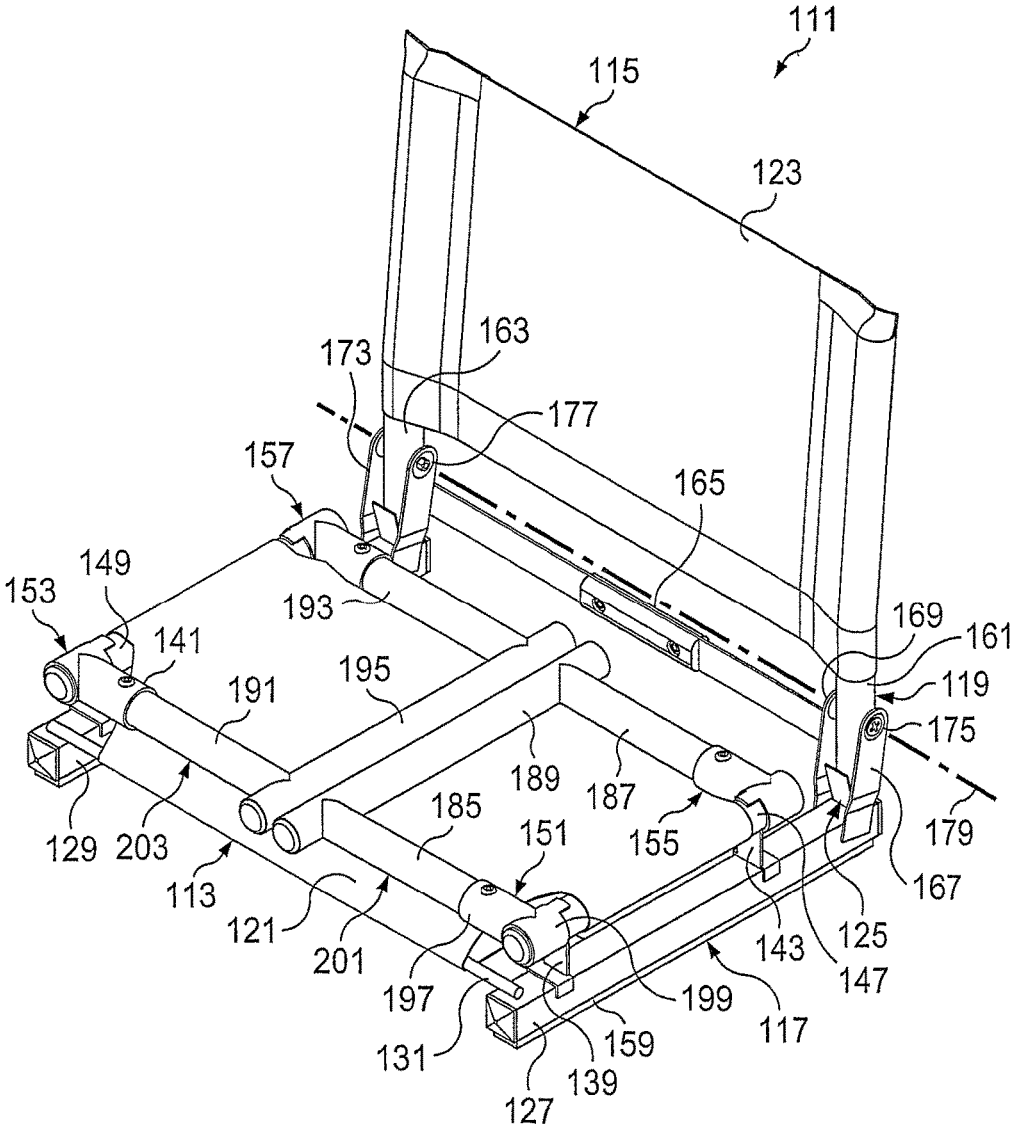
FIG. 5 is an oblique view of the chair of FIG. 1, showing components moved to a folded position.
Figure 6:
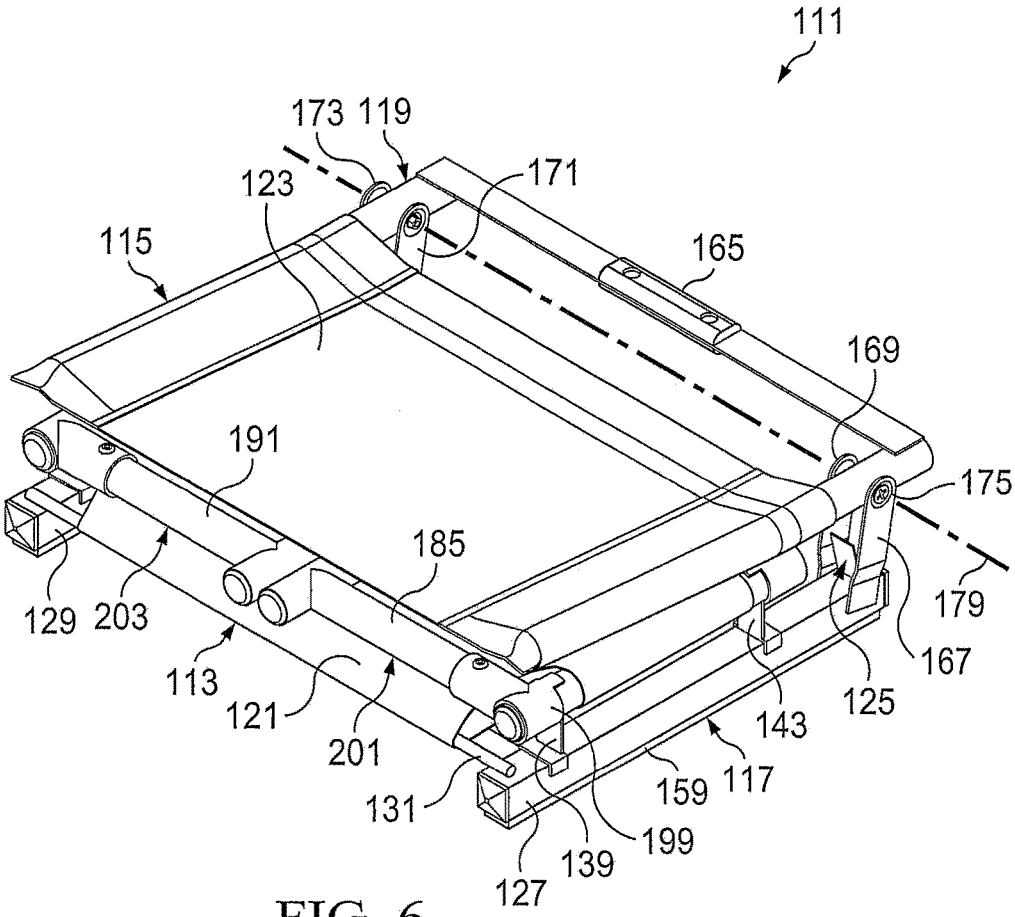
FIG. 6 is an oblique view of the chair of FIG. 1, showing components moved to a folded position.

Preferably, armrest structure 201 and second armrest structure 203 include pivoting action such that when first armrest structure 201 and second armrest structure 203 are in a generally horizontal orientation they pivot in a generally upward and outward direction and when first armrest structure 201 and second armrest structure 203 are in a generally vertical orientation they pivot in a generally downward and inward direction. As shown for this embodiment in FIG. 5, this pivoting action allows for armrest structures 201, 203 to be folded horizontal and adjacent webbing 121. In the embodiment shown, armrest structures 201, 203 are sized so that horizontal members 189, 195 are approximately laterally adjacent to each other when armrest structures 201, 203 are in the folded position. However, armrest structures 201, 203 may be constructed so that they overlap when folded or that horizontal members 189, 195 are spaced laterally from each other when folded. FIG. 6 shows backrest portion 115 rotated to a forward folded position, in which webbing 123 preferably lies adjacent armrest structures 201, 203.

It will be appreciated that alternative embodiment may be constructed so that first armrest frame 181 and second armrest frame 183 may be fixedly attached to first armrest mount base 147 and second armrest mount base 149, respectively, or to first fore-to-aft frame member 127 and second fore-to-aft frame member and 129, respectively.

Figure 7:
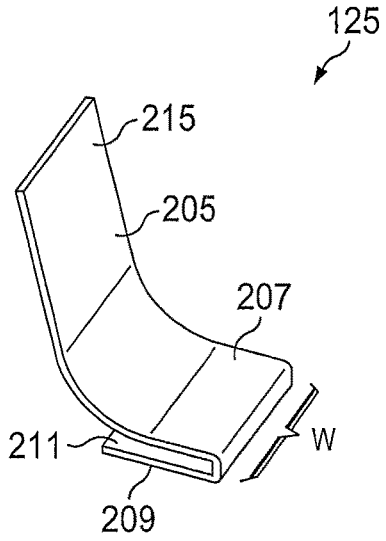
FIG. 7 is an oblique view of a biasing element of the chair of FIG. 1.
Figure 9:
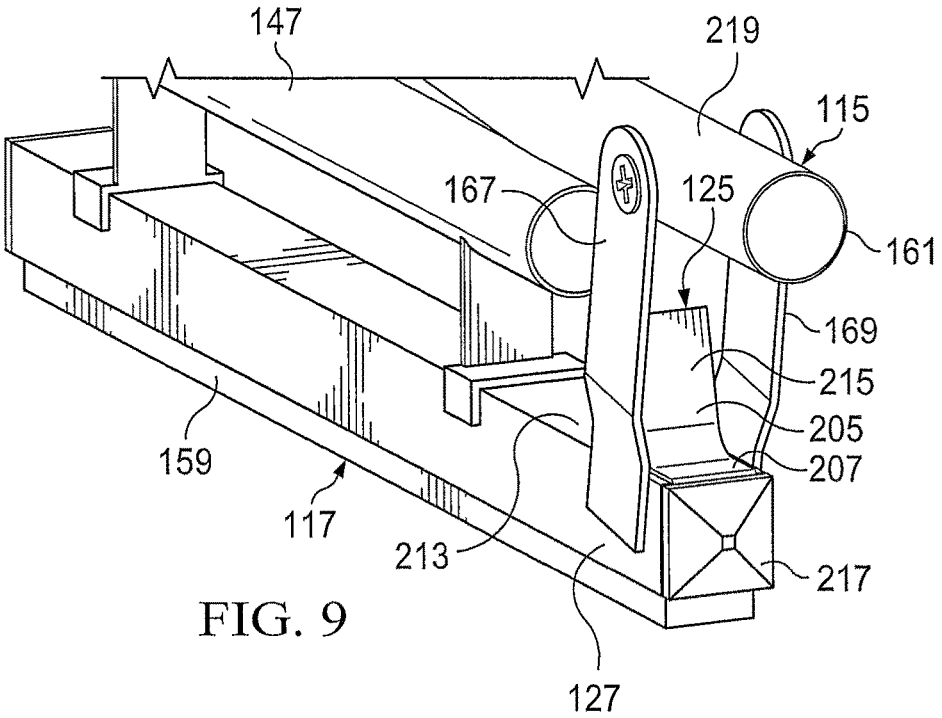
FIG. 9 is an enlarged view of a portion of the chair of FIG. 1, showing a backrest in a folded position.
Figure 8:
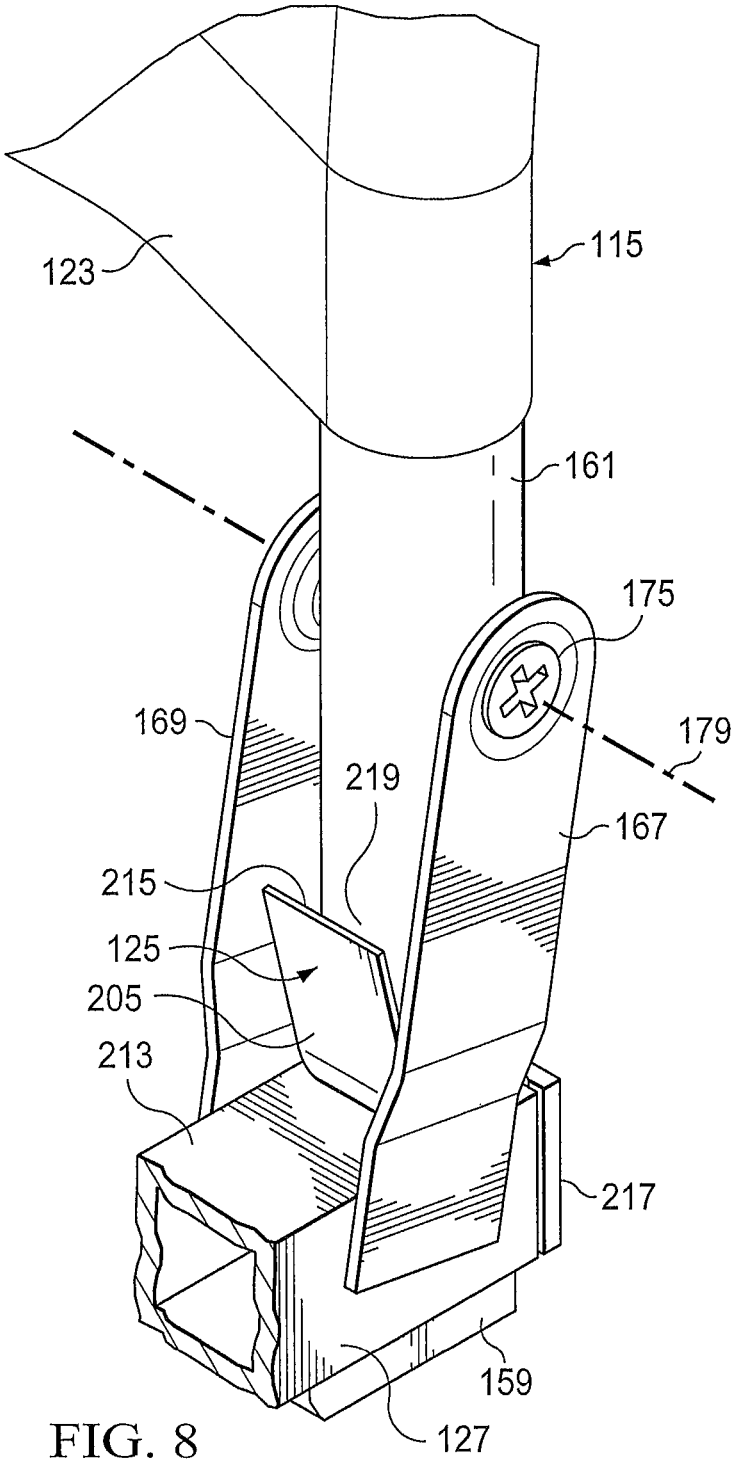
FIG. 8 is an enlarged view of a portion of the chair of FIG. 1, showing a backrest in a neutral position.

FIGS. 7 through 9 illustrate the details of biasing element 125 and the installation of biasing element 125 on chair 111. FIG. 7 shows biasing element 125 in an isolated view, whereas FIGS. 8 and 9 show backrest portion 115 in the neutral position and folded positions, respectively. Though details are shown for the components of only one side of chair 111, it should be understood that the details apply equally to similar components located on both sides of chair 111.

In the preferred embodiment, biasing element 125 is configured as a curved cantilever spring having an upper portion 205, a middle portion 207, and a lower portion 209.

As shown, biasing element 125 has an overall width measurement W that is less than the width of first and second fore-to-aft frame members 127 and 129. Element 125 is preferably a unitary piece of flat metal, though element 125 may be formed from other appropriate types of materials or in other configurations.

Upper portion 205 preferably forms an angle relative to middle portion 207 of between about 90° and about 180°. Lower portion 209 is preferably configured to be generally parallel to middle portion 207 and form a clearance 211 between middle portion 207 and lower portion 209, forming an integral clip for mounting element 125. Clearance 211 is preferably slightly less than a wall thickness of an upper longitudinal wall 213 of first seat portion fore-to-aft frame member 127, such that a press-fit connection is formed when biasing element 125 is pressed into the hollow rear end portion of frame member 127.

It will be appreciated that biasing element 125 may be attached in the same manner or method to either first fore-to-aft frame member 127, second fore-to-aft frame member 129, or both. Additionally, although the connection between biasing elements 125 and frame members 127, 129 has been expressed as a press-fit connection, it should be understood that there are many suitable methods of connecting biasing elements 125 and frame members 127, 129. For example, biasing elements 125 may be welded, riveted, glued, bolted, screwed, or otherwise connected and/or fastened to first and second fore-to-aft frame members 127 and 129.

FIG. 8 is an enlarged view of a portion of chair 111 and shows backrest portion 115 rotated to a neutral position relative to frame member 127. FIG. 9 is an enlarged view of a portion of chair 111 and shows backrest portion 115 rotated to a folded position relative to frame member 127. In both figures, biasing element 125 is shown installed in frame member 127, such that middle portion 207 lies adjacent upper portion 205 lies adjacent upper longitudinal wall 213 of frame member 127, and lower portion 207 is inserted within frame member 127. This positions element 125 between vertical mounting tabs 167 and 169 and positions upper portion 205 in a generally vertical orientation, with a contact surface 215 of upper portion 205 located forward of axis 179. An optional square plug 217 may be inserted into the end of frame member 127 for aesthetics and/or for assisting in retention of element 125.

This unique configuration provides stadium seat 111 with a reclining or rocking-type motion, in which the rocking-type motion of backrest portion 115 relative to seat frame 117 may be controlled and tailored, based upon the performance characteristics of biasing element 125. Biasing element 125 provides a resistive biasing force to the forward pivoting action of lower portion 219 of first backrest portion vertical frame member 161. In the embodiment shown, the configuration provides for unbiased forward rotation of backrest portion 115 from the neutral position, though alternative embodiments may be configured to have an over-center or similar feature to resist initial forward motion of backrest portion 115 from the neutral position.

A cantilever-spring configuration of biasing element 125 allows for compact installation onto frame member 127 between first seat portion vertical mounting tab 167 and second seat portion vertical mounting tab 169. First and second seat portion vertical mounting tabs 167 and 169 are fixedly attached to opposing sides of first fore-to-aft frame member 127, and the rear edges of seat portion vertical mounting tabs 167 and 169 extend upward in a generally vertical direction. It will be appreciated that seat portion vertical mounting tabs 167, 169, 171, and 173 may be inclined relative to first and second fore-to-aft frame members 127 and 129, respectively, at various selected angles, depending upon the desired operation of stadium seat 111.

In operation, stadium chair 111 functions in the following manner. The stadium chair 111 is removably attached to a bleacher seating beam by anchor device 137. From a collapsed configuration, backrest portion 115 of stadium chair 111 is rotated in an upward and rearward direction relative to seat portion 113 such that lower portion 219 of first backrest portion vertical frame member 161 (and/or similar components on the other side of chair 111) contact surface 215 of upper portion 205 of biasing element(s) 125. If installed, first armrest structure 201 and second armrest structure 203 are rotated in a generally upward and outward direction to a generally vertical orientation. When a user is seated in stadium chair 111 and leans into backrest portion 115, lower portion 219 of first backrest portion vertical frame member 161 rotatably acts upon upper portion 205 of biasing element(s) 125. Biasing element(s) 125 applies a resistive biasing force to lower portion 219 of first backrest portion vertical frame member 161, thereby controlling and limiting the limited reclining or rocking-type motion of backrest portion 115 relative to seat frame 117 (based upon the performance characteristics of biasing element(s) 125). As a force is applied to upper portion 205, biasing element(s) 125 resist movement until a pre-defined force threshold is reached. Once the pre-defined force threshold is reached, the angle between the upper portion 205 and the middle portion 207 of biasing element(s) 125 increases, thereby increasing the return biasing force applied to lower portion 219 of first backrest portion vertical frame member 161 by biasing element(s) in a generally logarithmic manner. The unique performance characteristics of biasing element(s) 125 are design features engineered to accommodate a wide variety of users.

It will be appreciated that the biasing element 125 could be produced in one or more configurations or a combination of configurations to accomplish the desired effect. For example, biasing element 125 could take the form of any appropriate type of elastic spring or gas spring. Biasing element 125 may comprise an elastomeric material or other suitably resistive and/or resilient material. In addition, biasing element 125 may be, for example, a leaf spring, coil spring, torsion spring, spring damper system, pneumatic damper system, and/or combinations thereof. In addition, alternative configurations may position biasing element 125 in another location, such as rearward of axis 179 and/or above axis 179. In other embodiments, biasing element 125 may be adjustable for altering the biasing force.

Figure 10:
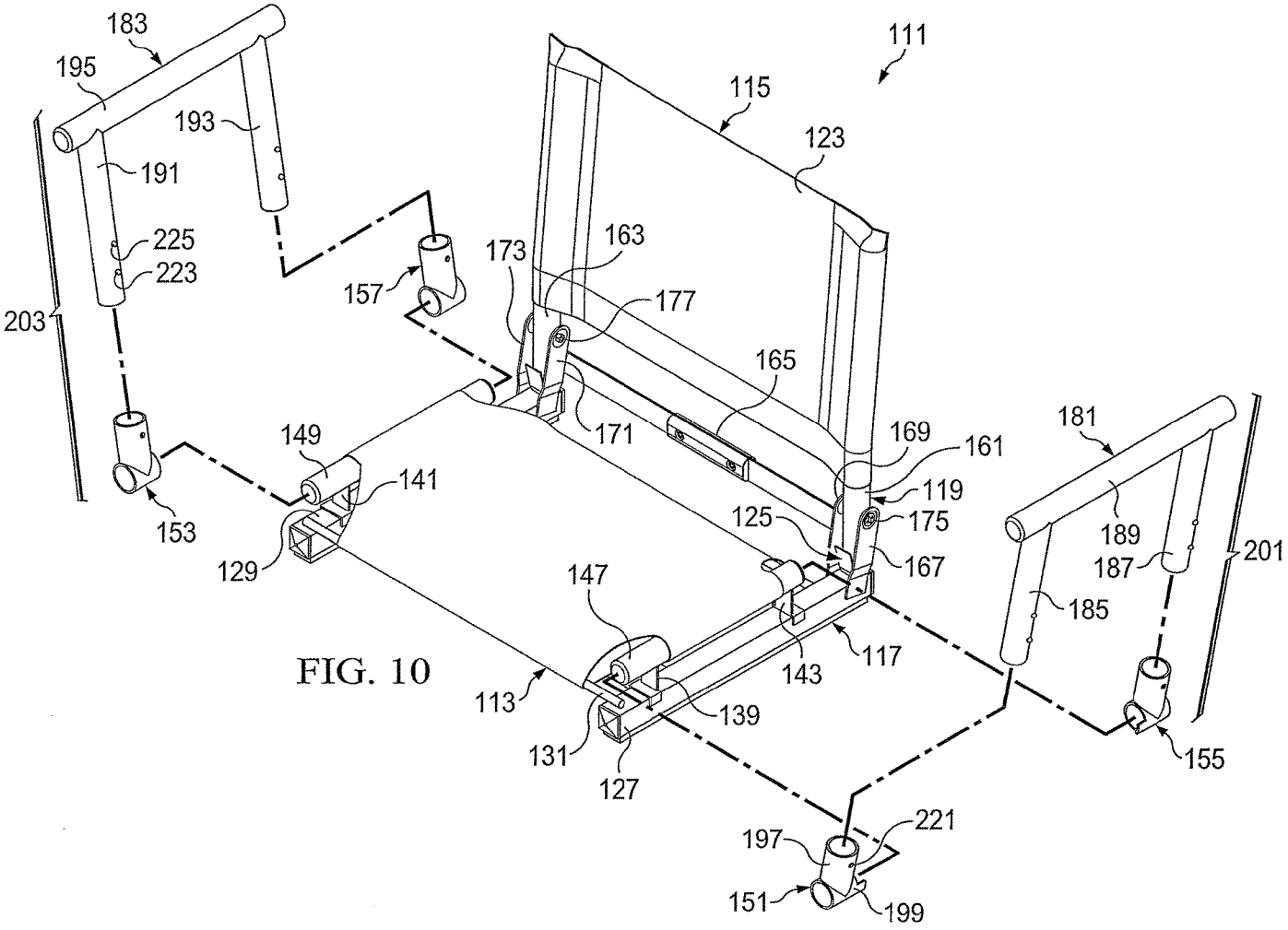
FIG. 10 is a partially exploded oblique view of the chair of FIG. 1.

FIG. 10 is a partially exploded view of chair 111 and illustrates the ability of the design to allow for armrest structures 201, 203 to be added or removed from armrest bases 147, 149 of seat frame 117 without the use of tools. In the preferred embodiment, as shown above, armrest mounts 151, 153, 155, 157 are pivotally carried by forward and rear ends of armrest bases 147, 149, and armrest frames 181, 183 are able to be removably attached to mounts 151, 153, 155, 157.

For installation of armrest structures 201, 203, each of mounts 151, 153, 155, 157 slides onto a forward or rear end of an armrest base 147, 149. This positions mounts 151, 153, 155, 157 to receive the lower ends of vertical frame member 185, 187, 191, 193 of armrest frames 181, 183. With each vertical frame member 185, 187, 191, 193 inserted into a vertical member 197 of a mount 151, 153, 155, 157, mounts 151, 153, 155, 157 are captured on armrest bases 147, 149 without the use of fasteners or tools.

To removably couple armrest frames 181, 183 to mounts 151, 153, 155, 157, each vertical member 197 of mounts 151, 153, 155, 157 has an aperture 221 sized and positioned for receiving a spring-biased detent 223 extending out of each vertical frame member 185, 187, 191, 193. In the preferred embodiment, each detent 223 has a button 225 that allows a user to depress button 225 for opposing the biasing force and retracting the associated detent 223 into the corresponding vertical frame member 185, 187, 191, 193. This allows the user to retract each detent 223 for inserting or removing armrest frames 181, 183, and this can be done without the need for tools. An advantage to having the ability to add or remove optional armrest structures 201, 203 is that the user may not want to use armrest frames 181, 183 and may want to also remove mounts 151, 153, 155, 157 for comfort. Another advantage is that chair 111 can be sold for a lower price without armrest structures 201, 203, and the user may later purchase armrest structures 201, 203 and add them to chair 111.

It should be noted that several variations and additions may be used with the stadium chair described above. For example, chairs may optionally include pouches configured for maintaining the temperature of hot or cold food or drink. Also, chairs may include a leg attachment for supporting the legs of the user.

The stadium chair of the present application provides several significant advantages, including: 1) providing for a reclining or rocking motion of a backrest portion relative to a seat portion; and 2) providing for optional armrests.

The particular embodiments disclosed above are illustrative only, as they may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that subject matter with significant advantages has been described and illustrated. Although the present application includes embodiments having a limited number of forms, it is not limited to just these forms, but is amenable to various changes and modifications without departing from the spirit thereof.

What is claimed is:

1. A stadium chair, comprising:
a seat frame; having;
a first tab; and
a second tab;
a backrest frame pivotally coupled to the seat frame between the first tab and the second tab for rotation about an axis, the backrest frame being capable of forward rotation about the axis toward the seat frame and rearward rotation about the axis away from the seat frame; and
a biasing element coupled to at least one of the seat frame and backrest frame for forward biasing the backrest frame toward a neutral position relative to the seat frame, the biasing element allowing for limited rearward rotation of the backrest frame from the neutral position and allowing for forward rotation of the backrest frame from the neutral position;
wherein the biasing element contacts the backrest frame; and
wherein the biasing element is located between the first tab and the second tab.

2. The stadium chair of claim 1, wherein the backrest frame is substantially rigid.

3. The stadium chair of claim 1, wherein the biasing element is a tension spring.

4. The stadium chair of claim 1, wherein the biasing element is a compression spring.

5. The stadium chair of claim 1, wherein the biasing element is an elastic spring.

6. The stadium chair of claim 1, wherein the biasing element is a gas spring.

7. The stadium chair of claim 1, wherein the biasing element is a cantilever spring coupled to the seat frame.

8. The stadium chair of claim 1, wherein the biasing element is adjustable for altering a biasing force.

9. The stadium chair of claim 1, further comprising: a pair of arms rotatably attached to the seat frame or backrest frame.

10. The stadium chair of claim 1, further comprising: a pair of removable arms rotatably attached to the seat frame or backrest frame.

11. A stadium chair, comprising:
a seat frame;
a backrest frame pivotally coupled to the seat frame for rotation about an axis, the backrest frame being capable of forward rotation about the axis toward the seat frame and rearward rotation about the axis away from the seat frame; and
a cantilever spring clips to the seat, frame for forward biasing the backrest frame toward a neutral position relative to the seat frame, the cantilever spring allowing for limited rearward rotation of the backrest frame from the neutral position and allowing for unbiased forward rotation of the backrest frame from the neutral position;
wherein the biasing element contacts the backrest frame.

12. The stadium chair of claim 11, wherein the backrest frame is substantially rigid.

13. The stadium chair of claim 11, further comprising: a pair of arms rotatably attached to the seat frame or backrest frame.

14. The stadium chair of claim 11, further comprising: a pair of removable arms rotatably attached to the seat frame or backrest frame.

15. A stadium chair, comprising:
a seat frame having an armrest base on each of opposing sides;
a backrest frame pivotally coupled to the seat frame for rotation about an axis, the backrest frame being capable of forward rotation about the axis toward the seat frame and rearward rotation about the axis away from the seat frame;
two biasing elements each having an end configured for clipping to the seat frame;
the two biasing elements clipped to the seat frame located adjacent the axis;
an armrest rotatably mounted to each armrest base, each armrest comprising:
an armrest frame; and
at least one armrest mount, each mount configured for being rotatably carried on one of the armrest bases;
wherein the two biasing elements are configured for limited rearward rotation of the backrest frame while the two biasing elements are in contact with the backrest frame.

16. The stadium chair of claim 15, wherein each armrest frame removably coupled to the associated at least one armrest mount.

17. The stadium chair of claim 15, wherein each armrest mount is removably carried by the associated armrest base.

18. A stadium chair, comprising:

a seat frame having an armrest base on each of opposing sides;

a backrest frame pivotally coupled to the seat frame for rotation about a hast axis, the backrest frame being capable of forward rotation about the first axis toward the seat frame and rearward rotation about the first axis away from the seat frame; and an armrest rotatably mounted to each armrest base, each armrest comprising:

a generally U-shaped armrest frame; and two armrest mounts, each mount configured for receiving a portion of the armrest frame and for being rotatably carried on one of the armrest bases;

wherein each armrest pivots about an armrest axis; and wherein each armrest axis is located above the seat frame; and wherein the first axis is located above each of the armrest axes.

19. The stadium chair of claim 18, wherein each armrest frame is removably coupled to the associated armrest mounts.

20. The stadium, chair of claim 18, wherein each armrest mount is removably carried by the associated armrest base.

21. The stadium chair of claim 18, further comprising: a biasing element coupled to at least one of the seat frame and backrest frame for forward biasing the backrest frame toward a neutral position relative to the seat frame, the biasing element allowing for limited rearward rotation of the backrest frame from the neutral position and allowing for forward rotation of the backrest frame from the neutral position, and wherein the biasing element is located between a first tab coupled to the seat frame and a second tab coupled to the seat frame.

* * * * *